United States Patent [19]

Iwaoka et al.

[11] 4,266,970

[45] May 12, 1981

[54] METHOD FOR BLOWING GAS FROM BELOW INTO MOLTEN STEEL IN REFINING VESSEL

[75] Inventors: Shoji Iwaoka, Ashiya; Hiroyuki Kaito; Shigeo Anzai, both of Takarazuka; Susumu Ushigome, Nagoya; Yoshiaki Watanabe; Nobuyuki Mimura, both of Tajimi, all of Japan

[73] Assignees: Kawasaki Steel Corporation, Kobe; Tokyo Yogyo Kabushiki Kaisha, Tokyo, both of Japan

[21] Appl. No.: 103,177

[22] Filed: Dec. 13, 1979

[30] Foreign Application Priority Data

| | | | |
|---|---|---|---|
| Dec. 21, 1978 | [JP] | Japan | 53-156869 |
| Dec. 21, 1978 | [JP] | Japan | 53-156870 |
| Dec. 21, 1978 | [JP] | Japan | 53-156871 |

[51] Int. Cl.[3] ..... C21C 5/34

[52] U.S. Cl. ..... 75/59; 75/60

[58] Field of Search ..... 75/59, 60

[56] References Cited

U.S. PATENT DOCUMENTS

| | | | |
|---|---|---|---|
| 3,330,645 | 7/1967 | De Moristier | 75/59 |
| 3,343,829 | 9/1967 | Coates | 75/59 |
| 3,610,602 | 10/1971 | Deacon | 75/59 |
| 3,619,172 | 11/1971 | Lutgen | 75/59 |

*Primary Examiner*—P. D. Rosenberg

*Attorney, Agent, or Firm*—Frishauf, Holtz, Goodman and Woodward

[57] ABSTRACT

A method for blowing a gas from below into a molten steel in a refining vessel, which comprises: using a refining vessel including at least one gas blowing aperture provided in the bottom wall thereof and a frustoconical plug matching with said aperture, releasably inserted into said gas blowing aperture, which has a small-diameter bore having a diameter within the range of from 0.5 to 6.0 mm and a length within the range of from 60 to 700 mm; closing the top end of said bore of said plug opening into said vessel with a granular packing easily removable by the pressure of a gas blown, thereby ensuring prevention of a molten steel received in said vessel from penetrating into said bore during receiving said molten steel into said vessel; after receiving a molten steel into said vessel, blowing from below a gas having a pressure of over the static pressure of said received molten steel through said bore of said plug into said molten steel, thereby removing said packing to effect a prescribed gas blowing into said molten steel; and, after discontinuing said gas blowing, causing a portion of said molten steel in said vessel to penetrate by gravity into said bore of said plug to solidify said molten steel in said bore, thereby closing said bore to ensure prevention of said molten steel in said vessel from flowing out from said vessel.

5 Claims, 8 Drawing Figures

METHOD FOR BLOWING GAS FROM BELOW INTO MOLTEN STEEL IN REFINING VESSEL

FIELD OF THE INVENTION

The present invention relates to a method for blowing a gas from below into a molten steel in a refining vessel, which permits stirring and refining of the molten steel in the refining vessel.

BACKGROUND OF THE INVENTION

With a view to applying vacuum decarburization, chemical composition adjustment, degassing and other refining treatments to a molten steel received in a refining vessel, a method is known which comprises blowing a gas from below into the molten steel received in the refining vessel under vacuum or in open air.

A conventional method for blowing the gas from below into the molten steel in the refining vessel as mentioned above comprises using a refining vessel provided with a porous plug in the bottom wall thereof, and blowing a gas through said porous plug into the molten steel in the refining vessel. FIG. 1 is a schematic sectional view illustrating the above-mentioned conventional refining vessel provided with a porous plug in the bottom wall thereof. In FIG. 1, 1 is a refining vessel, 1' is the bottom wall of the refining vessel 1, 1'' is the side wall of the refining vessel 1, and, both the bottom wall 1' and the side wall 1'' are formed with refractories and covered by a protecting steel sheet over the outer surface thereof.

The bottom wall 1' of the refining vessel 1 is provided with a gas blowing aperture 2 passing through the bottom wall 1'. A porous plug 3 having a shape just fitting in the gas blowing aperture 2 and made of a porous refractory is releasably inserted into the gas blowing aperture 2 from the outside of the bottom wall 1'. The porous plug 3 has such a permeability (i.e., porosity) that allows passing of a gas but not a molten steel. When a molten steel 4 is received in the refining vessel 1, therefore, the received molten steel 4 is prevented by the porous plug 3 from flowing out from the refining vessel 1. When a gas having a pressure of over the static pressure of the molten steel 4 is blown from below as shown by the arrow 5 in the drawing through the porous plug 3 into the molten steel 4 for the purpose of refining the molten steel 4 received in the refining vessel 1, the molten steel 4 in the refining vessel 1 is stirred and refined by the gas blown through the porous plug 3. Then, when gas blowing is discontinued, the molten steel 4 in the refining vessel 1 is prevented by the porous plug 3 from flowing out from the refining vessel 1.

As mentioned above, the molten steel 4 in the refining vessel 1 never flows out through the porous plug 3 before gas blowing and even after discontinuing gas blowing, by using a refining vessel 1 equipped with a porous plug 3 in the bottom wall 1' thereof. It is therefore possible also to interrupt gas blowing during refining.

However, because the permeability (i.e., porosity) of the porous plug depends upon the material particle size, the firing temperature and other manufacturing conditions, it is necessary to closely control the manufacturing conditions mentioned above when manufacturing a porous plug, thus requiring higher manufacturing costs. Furthermore, a slight change in the manufacturing conditions tends to cause variation in permeability of the porous plug manufactured. When employing a porous plug having a permeability of over a certain value, a trouble may be caused in which the received molten steel flows out through the porous plug from the refining vessel. Since the amount of gas blown through a porous plug is limited to a certain extent, it is impossible to blow a gas at a high flow rate into the molten steel. As a solution to this inconvenience, a method is known which comprises inserting a plurality of porous plugs into the bottom wall of the refining vessel and blowing a gas simultaneously through said plurality of porous plugs. This method is however problematic from the point of view of economy and safety. Furthermore, because the porous plug may easily be broken, insertion thereof into the bottom wall of the refining vessel should be carefully conducted, thus requiring a long period of time for replacing the porous plug, and hence leading to a low operational efficiency of the refining vessel.

Another conventional method for blowing a gas from below into a molten steel received in a refining vessel is known, which comprises using a refining vessel provided with a gas blowing hole in the bottom wall thereof, and blowing a gas through the gas blowing hole into the molten steel received in the refining vessel. The gas flowing hole of the refining vessel used in the above-mentioned conventional method for blowing a gas has a diameter of from about 10 mm to about 20 mm. It is therefore possible to blow the gas at a high flow rate into the molten steel in the refining vessel.

In the above-mentioned conventional method for blowing a gas, however, the molten steel in the refining vessel flows out unless, before gas blowing and after discontinuing gas blowing, the refining vessel is tilted so that the hole becomes higher in altitude than the molten steel level in the refining vessel. For this purpose, it is necessary to install a tilting mechanism of the refining vessel, thus requiring high installation costs. Furthermore, if start of gas blowing into the molten steel is not closely associated in timing with start of tilting the refining vessel, the molten steel flows out from the hole and may cause a serious accident.

Under such circumstances, there has been a demand for developing a method for blowing a gas from below into a molten steel in a refining vessel, which, before gas blowing and after discontinuing gas blowing, permits easy and certain prevention of the molten steel in the refining vessel from flowing out from the gas blowing aperture provided in the bottom wall of the vessel, allows blowing of the gas in a large quantity into the molten steel in the refining vessel, and enables to freely select a flow rate of the gas to be blown, but such a method is not as yet proposed.

SUMMARY OF THE INVENTION

A principal object of the present invention is therefore to provide a method for blowing a gas from below into a molten steel received in a refining vessel, which permits easy and certain prevention of the molten steel received in said refining vessel from penetrating into a gas blowing aperture provided in the bottom wall of said vessel before gas blowing and after discontinuing gas blowing.

Another object of the present invention is to provide a method for blowing a gas from below into a molten steel received in a refining vessel, which permits blowing of a gas in a large quantity and free selection of a flow rate of the gas to be blown.

In accordance with one of the features of the present invention, there is provided a method for blowing a gas from below into a molten steel received in a refining vessel, which comprises:

using a refining vessel including at least one gas blowing aperture provided in the bottom wall thereof and a frustoconical plug matching with said gas blowing aperture, releasably inserted into said gas blowing aperture from the outside of said bottom wall, which has a small-diameter bore having a diameter within the range of from 0.5 to 6.0 mm and a length within the range of from 60 to 700 mm;

closing the top end of said small-diameter bore of said plug into said vessel with a granular packing easily removable by the pressure of the gas blown, thereby ensuring prevention, during receiving a molten steel into said vessel, of said received molten steel from penetrating into said small-diameter bore;

blowing from below a gas having a pressure of over the static pressure of said molten steel, after receiving said molten steel in said vessel, into said received molten steel, thereby instantaneously moving said packing to effect a prescribed gas blowing into said molten steel; and after discontinuing said gas blowing, causing a portion of said molten steel in said vessel to penetrate by gravity into said small-diameter bore of said plug to solidify the molten steel in said small-diameter bore, thereby closing said small-diameter bore to ensure prevention of said molten steel in said vessel from flowing out from said vessel.

DETAILED DESCRIPTION OF PREFERRED EMBODIMENTS

From the point of view as described above, we carried out extensive studies to solve the above-mentioned problems encountered when blowing a gas from below into a molten steel received in a refining vessel, and thus to develop a method for blowing a gas from below into a molten steel in a refining vessel, which, before gas blowing and after discontinuing gas blowing, permits easy and certain prevention of the molten steel in the refining vessel from flowing our from the gas blowing aperture provided in the bottom wall of the vessel, allows blowing of the gas in a large quantity into the molten steel in the refining vessel, and enables to freely select a flow rate of the gas to be blown. As a result, a method for blowing a gas from below into a molten steel received in a refining vessel was developed, which comprises:

using a refining vessel including at least one gas blowing aperture provided in the bottom wall thereof and a frustoconical plug matching with said gas blowing aperture, releasably inserted into said gas blowing aperture from the outside of said bottom wall, which has a small-diameter bore having a diameter within the range of from 0.5 to 6.0 mm and a length within the range of from 60 to 700 mm;

closing the top end of said small-diameter bore of said plug opening into said vessel with a granular packing easily removable by the pressure of the gas blown, thereby ensuring prevention, during receiving a molten steel into said vessel, of said received molten steel from penetrating into said small-diameter bore;

blowing from below a gas having a pressure of over the static pressure of said molten steel, after receiving said molten steel in said vessel, into said received molten steel, thereby instantaneously removing said packing to effect a prescribed gas blowing into said molten steel; and, after discontinuing said gas blowing, causing a portion of said molten steel in said vessel to penetrate by gravity into said small-diameter bore of said plug to solidify the molten steel in said small-diameter bore, thereby closing said small-diameter bore to ensure prevention of said molten steel in said vessel from flowing out from said vessel.

Now, the method for blowing a gas from below into a molten steel received in a refining vessel of the present invention is described with reference to the drawings.

Figure 1:
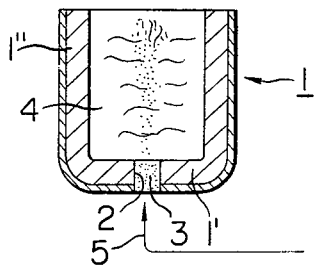
FIG. 1 is a schematic sectional view illustrating a conventional refining vessel provided with a porous plug in the bottom wall thereof, used for blowing a gas from below into a molten steel received therein.
Figure 2:
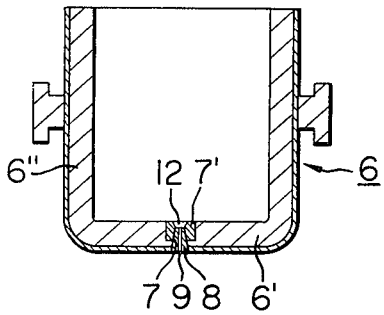
FIG. 2 is a schematic sectional view illustrating an embodiment of the refining vessel used in the method for blowing a gas from below into a molten steel received in said refining vessel of the present invention.

FIG. 2 is a schematic sectional view illustrating an embodiment of the refining vessel used in the method for blowing a gas from below into a molten steel received in said refining vessel of the present invention. In FIG. 2, 6 is a refining vessel, 6' is the bottom wall of the refining vessel 6, 6'' is the side wall of the refining vessel 6, and, both the bottom wall 6' and the side wall 6'' are formed with refractories and covered by a protecting steel sheet over the outer surface thereof.

Figure 3:
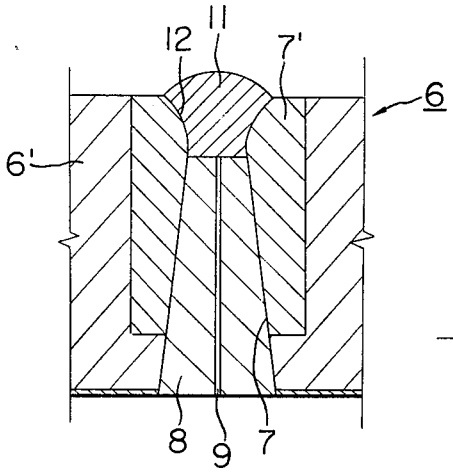
FIG. 3 is a partially enlarged sectional view illustrating the insertion of the plug into the gas blowing aperture provided in the bottom wall of the refining vessel shown in FIG. 2.

The bottom wall 6' of the refining vessel 6 is provided with a gas blowing aperture 7 passing through the bottom wall 6''. The gas blowing aperture 7 is formed, as shown in FIGS. 2 and 3, by an annular refractory 7'. The gas blowing aperture 7 flares from the inside to the outside of the bottom wall 6'', and the top end of the gas blowing aperture 7 communicates with the inner surface of the bottom wall 6", with a slow curve in between. In the gas blowing aperture 7, a frustoconical plug 8 matching with the aperture 7 is releasably inserted from the outside of the bottom wall 6' so that the top end of the plug 8 is located at a position lower than the inner surface of the bottom wall 6'. Thus, a recess 12 is formed with the top end of the plug 8 as the bottom surface on the plug 8.

In the plug 8, a small-diameter bore 9 passing therethrough is formed along the center axis thereof. The small-diameter bore 9 may be formed either by piercing the plug 8 itself as shown in FIG. 3, or by embedding a metal tube 10 made of a stainless steel or an ordinary steel along the center axis of the plug 8 as shown in the partially enlarged sectional view of FIG. 4. When the small-diameter bore 9 is formed by embedding the metal tube 10, the metal tube 10 may project from the bottom surface of the plug 8. It is therefore possible to utilize, when connecting a gas feeding pipe to the plug 8, the projected portion of the metal tube 10, thus providing an advantage of allowing easy connection. The small-diameter bore 9 provided in the plug 8 should have such a diameter and a length that allow the molten steel penetrating into the small-diameter bore 9 to be solidified immediately to close the small-diameter bore 9. According to the results of many tests which we actually carried out with regard to appropriate diameter and length of the small-diameter bore 9, the small-diameter bore 9 should have a diameter within the range of from 0.5 to 6.0 mm and a length within the range of from 60 to 700 mm depending upon the selected diameter of the small-diameter bore 9.

FIG. 3 is a partially enlarged sectional view illustrating the insertion of the plug 8 into the gas blowing aperture 7 provided in the bottom wall 6'. As shown in FIG. 3, a granular packing 11 is placed in the recess 12 formed on the top of the gas blowing aperture 7 with the top end surface of the plug 8 as the bottom surface. The packing 11 closes the top end opening of the small-diameter bore 9, thus preventing, during receiving a molten steel in the refining vessel 6, the molten steel thus received from penetrating into the small-diameter bore 9.

The packing 11 should have a particle size of larger than the diameter of the small-diameter bore 9 so that the granular packing 11 does not fall into the small-diameter bore 9 of the plug 8. The material of the packing 11 should have such properties that, when receiving a molten steel in the refining vessel 6, prevents the molten steel from penetrating into the packing 11 in the recess 12 by forming a thin sintered film under the effect of heat of the received molten steel, and when blowing a gas through the small-diameter bore 9 of the plug 8 mentioned later into the refining vessel 6, is easily removable under the effect of the pressure of the blown gas. As the material of the packing 11, magnesia clinker, chromite, cutting scrap or silica sand is used, and, with magnesia clinker as the lowermost layer in the recess 12, at least one of chromite, cutting scrap and silica sand is piled up in layers. The packing 11 placed in the recess 12 should preferably have a total thickness of from 10 to 150 mm. Because, with a total thickness of the packing 11 of under 10 mm, an effect as the packing cannot be obtained, whereas, with a total thickness of the packing 11 of over 150 mm, a very high pressure of the blown gas is required for removing the packing 11 when blowing the gas through the small-diameter bore 9 described later.

In the method for blowing a gas of the present invention, the plug 8 having the small-diameter bore 9, coated with mortar on the outer surface thereof, is inserted into the gas blowing aperture 7 from the outside of the bottom wall 6' of the refining vessel 6, then, the packing 11 is placed in the recess 12 formed on the top of the gas blowing aperture 7 with the top end surface of the plug 8 as the bottom surface to close the top end opening of the small-diameter bore 9 formed in the plug 8, and then, a molten steel is received in the refining vessel 6. Since the top end of the small-diameter bore 9 of the plug 8 is closed by the packing 11, the molten steel received is prevented from penetrating into the small-diameter bore 9. Then, for the purpose of refining the molten steel received in the refining vessel 6, a gas having a pressure of over the static pressure of the molten steel is blown from below through the small-diameter bore 9 of the plug 8 into the molten steel. Since the packing 11 closing the top end opening of the small diameter bore 9 is instantaneously removed by the pressure of the gas blown, the gas is blown through the small-diameter bore 9 of the plug 8 at a sufficiently high flow rate into the molten steel, and thus, the molten steel in the refining vessel 6 is stirred by the gas blown at the sufficiently high flow rate and efficiently refined.

Then, when blowing of the gas is discontinued, a portion of the molten steel in the refining vessel 6 penetrates by gravity into the small-diameter bore 9 of the plug 8, cooled and solidified in the small-diameter bore 9, and thus closes the small-diameter bore 9, whereby the molten steel in the refining vessel is certainly prevented from flowing out.

Then, the refining vessel 6 is moved by a crane (not shown) to the casing plant, and the refined molten steel is poured through a teeming nozzle (not shown) provided in the bottom wall 6' of the refining vessel 6 into a casting mold (not shown). After the completion of pouring of the molten steel, the plug 8 is withdrawn from the gas blowing aperture 7 formed in the bottom wall 6' of the refining vessel 6, and a new plug 8 is inserted into the gas blowing aperture 7 of the bottom wall 6' for the next refining operation. The plug 8 can be very easily replaced within about 10 minutes.

Figure 5:
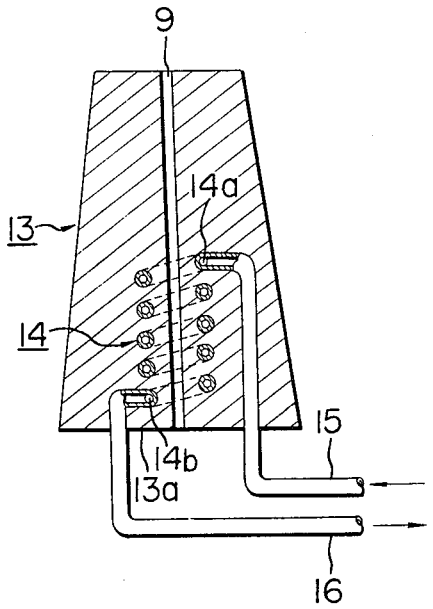
FIG. 5 is a partially enlarged sectional view illustrating another embodiment of the plug inserted into the gas blowing aperture provided in the bottom wall of the refining vessel shown in FIG. 2.

FIG. 5 is a partially enlarged sectional view illustrating another embodiment of the plug used in the method of the present invention. More specifically, a plug 13 shown in FIG. 5 has a frustoconical shape as in the plug 8 described above with reference to FIGS. 2 and 3, and is provided with the small-diameter bore 9 passing therethrough along the center axis thereof. A helical cooling pipe 14 is embedded in the lower part of the plug 13 shown in FIG. 5 so as to surround the small-diameter bore 9. The upper end 14*a* of the cooling pipe 14 is connected with a cooling water feed pipe 15 projecting downwardly from the bottom surface 13*a* of the plug 13, and the lower end 14*b* of the cooling pipe 14 is connected with a cooling water discharge pipe 16 projecting downwardly from the bottom surface 13*a* of the plug 13. The plug 13 having the above-mentioned structure, coated with mortar on the outer surface thereof, is inserted into the gas blowing aperture 7 from the outside of the bottom wall 6' of the refining vessel 6. The cooling water feed pipe 15 and the cooling water discharge pipe 16 are connected with a cooling water source (not shown), and cooling water is circulated in the cooling pipe 14 surrounding the small-diameter bore 9 of the plug 13 to forcedly cool the lower part of the small-diameter bore 9. When using the plug 13 shown in FIG. 5, the molten steel having penetrated into the small-diameter bore 9 after the completion of gas blowing is effectively cooled and solidified in the small-diameter bore 9 to close the bore 9. In the plug 13 shown in FIG. 5, therefore, the small-diameter bore 9 may have a relatively large diameter and a relatively small length.

Figure 6:
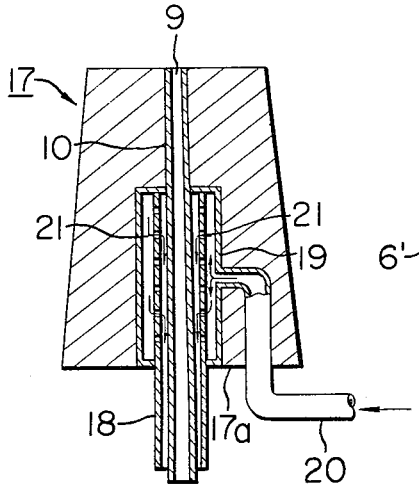
FIG. 6 is a partially enlarged sectional view illustrating further another embodiment of the plug inserted into the gas blowing aperture provided in the bottom wall of the refining vessel shown in FIG. 2.

FIG. 6 is a partially enlarged sectional view illustrating further another embodiment of the plug used in the method of the present invention. More specifically, the small-diameter bore 9 of a plug 17 shown in FIG. 6 is formed, like the plug 8 shown in FIG. 4, by embedding a metal tube 10 made of a metal such as a stainless steel and an ordinary steel along the center axis of the plug 17. The metal tube 10 projects downwardly from the bottom surface 17*a* of the plug 17. Around the lower part of the metal tube 10, a cooling air inner pipe 18 and a cooling air outer pipe 19 are provided concentrically with the metal tube 10, with the cooling air outer pipe 19 arranged outermost. The cooling air outer pipe 19 is connected with a cooling air feed pipe 20. The cooling air inner pipe 18 is provided with a plurality of holes 21 on the periphery thereof. Cooling air fed from the cooling air feed pipe 20 into the cooling air outer pipe 19 is ejected into the cooling air inner pipe 18, as shown by the arrow in the drawing, through the plurality of holes 21 provided on the periphery of the cooling air inner pipe 18 to cool the lower part of the metal tube 10, and then discharged to outside from the lower end of the cooling air inner pipe 18 as shown by the arrow in the drawing. The plug 17 having the above-mentioned structure, coated with mortar on the outer surface thereof, is inserted into the gas blowing aperture 7 from the outside of the bottom wall 6′ of the refining vessel 6, and the cooling air feed pipe 20 is connected with a cooling air source (not shown). The lower part of the metal tube 10 is forcedly cooled by circulating cooling air in the cooling air inner pipe 18 and the cooling air outer pipe 19 surrounding the metal tube 10. When using the plug 17 shown in FIG. 6, as in the case of using the plug 13 shown in FIG. 5, the molten steel having penetrated into the metal tube 10 after the completion of gas blowing is effectively cooled and solidified in the metal tube 10 to close the metal tube 10.

As described above with reference to FIGS. 5 and 6, by forcedly cooling the portion of the plug surrounding the small-diameter bore, it is possible to select a combination of a diameter and a length of the small-diameter bore within a wider range than in the case without forced cooling of the portion of the plug surrounding the small-diameter bore, i.e., within the aforementioned range of diameter of from 0.5 to 6.0 mm and that of length of from 60 to 700 mm, this forming one of the features of the method of the present invention.

Figure 7:
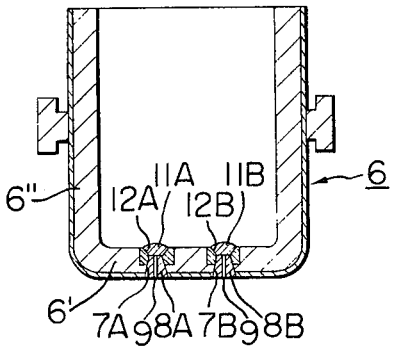
FIG. 7 is a schematic sectional view illustrating another embodiment of the refining vessel used in the method for blowing a gas from below into a molten steel received in said refining vessel of the present invention.

Now, another embodiment of the method of the present invention is described. FIG. 7 is a schematic sectional view illustrating another embodiment of the refining vessel used in the method of the present invention. Two gas blowing apertures 7A and 7B are formed at a prescribed distance in the bottom wall 6′ of the refining vessel 6. Plugs 8A and 8B each provided with a small-diameter bore 9 are respectively inserted into the gas blowing apertures 7A and 7B. Recesses 12A and 12B are formed, with the top end surfaces of the plugs 8A and 8B as the bottom surfaces, on the tops of the gas blowing apertures 7A and 7B, and packings 11A and 11B made of any of the aforementioned materials are previously placed in said recesses 12A and 12B. The top end openings of the respective small-diameter bores 9 provided in the plugs 8A and 8B are closed by the packings 11A and 11B, thus preventing, during receiving a molten steel into the refining vessel 6, the molten steel thus received from penetrating into the small-diameter bores 9.

After the refining vessel 6 having the structure as described above has received the molten steel, the refining vessel 6 is housed, for example, in a vacuum chamber (not shown), and a gas is blown from below into the molten steel in the refining vessel 6 through the small-diameter bore 9 of the plug 8A. Since the packing 11A closing the top end opening of the small-diameter bore 9 is instantaneously removed by the pressure of the gas blown, the gas is blown into the molten steel in the refining vessel 6 through the small-diameter bore 9 of the plug 8A at a sufficiently high flow rate, and thus, the molten steel in the refining vessel 6 is stirred by the gas blown, permitting vacuum decarburization treatment of the molten steel. When gas blowing through the small-diameter bore 9 of the plug 8A is discontinued after the completion of the vacuum decarburization treatment, a portion of the molten steel in the refining vessel 6 penetrates by gravity into the small-diameter bore 9 of the plug 8A, and is cooled and solidified in the bore 9 to close the bore 9. Then, the refining vessel 6 is moved to outside the vacuum chamber, and after adding chemical composition adjusting agents and other additives to the molten steel in open air, a gas is blown from below into the molten steel through the small-diameter bore 9 of the other plug 8B. Since the packing 11B closing the top end opening of the small-diameter bore 9 is instantaneously removed by the pressure of the gas blown, the gas is blown into the molten steel in the refining vessel 6 through the small-diameter bore 9 of the plug 8B at a sufficiently high flow rate, and thus, the molten steel in the refining vessel 6 is stirred by the gas blown, permitting refining in open air. When gas blowing through the small-diameter bore 9 of the plug 8B is discontinued after the completion of the refining in open air, a portion of the molten steel in the refining vessel 6 penetrates by gravity into the small-diameter bore 9 of the plug 8B, and is cooled and solidified in the bore 9 to close the bore 9. Then, the refining vessel 6 is moved to the casting plant, and the refined molten steel is poured into a casting mold.

Figure 8:
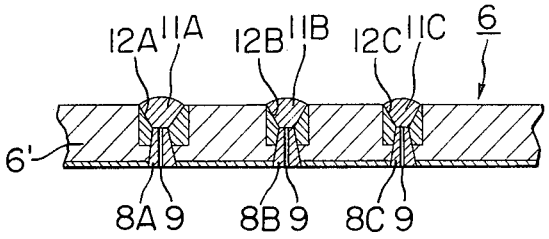
FIG. 8 is a partially enlarged sectional view illustrating further another embodiment of the refining vessel used in the method for blowing a gas from below into a molten steel received in said refining vessel of the present invention.

As described above, insertion of the two plugs 8A and 8B into the refining vessel 6 permits two-stage refining including interruption of gas blowing into the molten steel. The number of plugs is not limited to two, but any number of plugs may be inserted as required. For example, as shown in the partially enlarged sectional view of the bottom wall of the refining vessel in FIG. 8, three plugs 8A, 8B and 8C each having a small-diameter bore 9 may be inserted into the bottom wall 6′ of the refining vessel 6, and packings 11A, 11B and 11C may be placed respectively in recesses 12A, 12B and 12C formed on the tops of the plugs 8A, 8B and 8C. In this case, it is possible to apply three-stage refining including two interrruptions of gas blowing into the molten steel.

As mentioned above, insertion of a plurality of plugs into the bottom wall 6′ of the refining vessel 6 permits not only multiple-stage refining, but also sampling of the molten steel during refining.

The cases where a packing 11 used to previously close the top end opening of the small-diameter bore 9 of the plug 8 inserted into the bottom wall 6′ of the refining vessel 6 have been described above, but depending upon the plant layout, it is possible to use the gas blown through the small-diameter bore 9 of the plug 8 instead of the aforementioned packing 11. More particularly, prior to receiving the molten steel into the refining vessel 6, a gas is previously blown through the small-diameter bore 9 of the plug 8, and the molten steel is received into the refining vessel 6 while continuing gas blowing. Then, a prescribed refining is carried out by stirring the molten steel with the gas blown continuously. After the completion of refining, by discontinuing gas blowing, a portion of the molten steel in the refining vessel 6 penetrates into the small-diameter bore 9 of the plug 8, is cooled and solidified in the bore 9, and thus closes the bore 9.

Now, the method of the present invention is described more in detail by means of examples.

EXAMPLE 1

A refining vessel 6 with a plug 8 having the shape as shown in FIG. 3 inserted into the bottom wall 6' thereof was employed. The refining vessel 6 had a capacity capable of receiving 50 tons of molten steel, and the bottom wall 6' had a thickness of 450 mm.

The plug 8 was made of a high-alumina refractory, and a small-diameter bore 9 was formed directly in the plug 8. The small-diameter bore 9 had a diameter of 3.0 mm and a length of 340 mm. In a recess formed with the top end surface of the plug 8 as the bottom surface, 5.2 kg of magnesia clinker having a particle size of from 3.5 to 5.0 mm were placed, and on the layer of magnesia clinker, 8.3 kg of chromite having a particle size of form 0.1 to 2.0 mm, and then 40.0 kg of cutting scrap were pile up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 8 under a pressure of 6.0 kg/cm$^2$ and at a flow rate of 310 Nl/minute. The packing 11 in the recess 12 was instantaneously removed by the pressure of the argon gas thus blown. Argon gas was continuously blown under a pressure of from 6.0 to 6.5 kg/cm$^2$ and at a flow rate of from 300 to 330 Nl/minute for 20 minutes. After the completion of the above-mentioned vacuum decarburization refining, the vacuum chamber was released to open air, and argon gas was continuously blown in open air under a pressure of 1.1 kg/cm$^2$ at at a flow rate of 15 Nl/minute for 20 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9, and thus closed the bore 9. Then, the refining vessel 6 was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 8 was observed, and the small-diameter bore 9 having a length of 340 mm was completely closed by solidified steel over a depth of 220 mm from the top end thereof.

EXAMPLE 2

Figure 4:
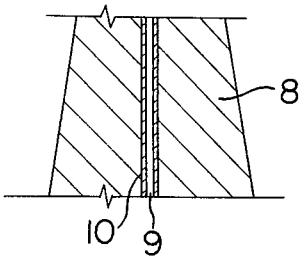
FIG. 4 is a partially enlarged sectional view illustrating an embodiment of the plug inserted into the gas blowng aperture provided in the bottom wall of the refining vessel shown in FIG. 2.

A refining vessel 6 identical with that in Example 1 was used except that a plug 8 having the shape as shown in FIG. 4 was inserted.

The plug 8 was made of a high-alumina refractory, and a small-diameter bore 9 was formed by embedding a metal tube 10 made of stainless steel. The small-diameter bore 9 had a diameter of 3.0 mm and a length of 340 mm. In a recess 12 formed with the top end surface of the plug 8 as the bottom surface, 3.0 kg of magnesia clinker having a particle size of from 3.5 to 5.0 mm were placed, and on the layer of magnesia clinker, 8.1 kg of chromite having a particle size of from 0.1 to 2.0 mm were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburizagtion to the molten steel in the refining vessel 6. Under vacuum, argon gas was blown into the molten steel in the refining vessel 6 through the small-diameter bore 9 of the plug 8 under a pressure of 6.0 kg/cm$^2$ and at a flow rate of 310 Nl/minute. The packing 11 in the recess 12 was instantaneously removed by the pressure of the argon gas thus blown. Argon gas was continuously blown under a pressure of from 6.0 to 6.6 kg/cm$^2$ and at a flow rate of from 310 to 340 Nl/minute for 25 minutes. After the completion of the above-mentioned vacuum decarburization refining, the vacuum chamber was released to open air, and argon gas was continuously blown in open air under a pressure of 1.1 kg/cm$^2$ and at a flow rate of 25 Nl/minute for 25 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9, and thus closed the bore 9. Then, the refining vessel 6 was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 8 was observed, and the small-diameter bore 9 having a lengrth of 340 mm was completely closed by solidified steel over a depth of 180 mm from the top end thereof.

EXAMPLE 3

A refining vessel 6 identical with that in Example 1 was employed.

The plug 8 was made of a high-alumina refractory, and a small-diameter bore 9 was formed directly in the plug 8. The small-diameter bore 9 had a diameter of 0.5 mm and a length of 100 mm. In a recess 12 formed with the top end surface of the plug 8 as the bottom surface, 2.0 kg of magnesia clinker having a particle size of from 1.0 to 3.0 mm were placed, and on the layer of magnesia clinker 7.5 kg of chromite having a particle size of from 0.1 to 2.0 mm, and then 35.0 kg of cutting scrap were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 8 under a pressure of 8.0 kg/cm$^2$ and at a flow rate of 70 Nl/minute. The packing 11 in the recess 12 was instantaneously removed by the pressure of the argon gas thus blown. Argon gas was continuously blown under a pressure of 8.0 kg/cm$^2$ and at a flow rate of from 65 to 70 Nl/minute for 27 minutes. After the completion of the above-mentioned vacuum decarburization refining, the vacuum chamber was released to open air, and argon gas was continuously blown in open air under a pressure of 2.0 kg/cm$^2$ and at a flow rate of 10 Nl/minute for 20 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9, and thus closed the bore 9. Then, the refining vessel was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 8 was observed, and the small-diameter bore 9 having a length of 100 mm was completely closed by solidified steel over a depth of 20 mm from the top end thereof.

EXAMPLE 4

A refining vessel 6 identical with that in Example 1 was employed except that the bottom wal 6' thereof had a thickness of 700 mm.

The plug 8 was made of a high-alumina refractory, and a small-diameter bore 9 was formed directly in the plug 8. The small-diameter bore 9 had a diameter of 6.0 mm and a length of 600 mm. In a recess 12 formed with the top end surface of the plug 8 as the bottom surface, 3.5 kg of magnesia clinker having a particle size of from 7.0 to 9.0 mm were placed, and on the layer of magnesia clinker, 8.2 kg of chromite having a particle size of from 0.1 to 2.0 mm, and then 45.0 kg of cutting scrap were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 8 under a pressure of 5.0 kg/cm$^2$ and at a flow rate of 550 Nl/minute. The packing 11 in the recess 12 was instantiously removed by the pressure of the argon gas thus blown. Argon gas was continuously blown under a pressure of from 5.0 to 5.5 kg/cm$^2$ and at a flow rate of from 530 to 550 Nl/minute for 22 minutes. After the completion of the above-mentioned vacuum decarburization refining, the vacuum chamber was released to open air, and argon gas was continuously blown in open air under a pressure of 1.5 kg/cm$^2$ and at a flow rate of 240 Nl/minute for 8 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9 and thus closed the bore 9. Then, the refining vessel was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 8 was observed, and the small-diameter bore 9 having a length of 600 mm was completely closed by solidified steel over a depth of 560 mm from the top end thereof.

EXAMPLE 5

A refining vessel 6 identical with that in Example 2 was employed except that the bottom wall 6' thereof had a thickness of 700 mm.

The plug 8 was made of a high-alumina refractory, and a small-diameter bore 9 was formed by embedding a metal tube 10 made of stainless steel. The small-diameter bore 9 had a diameter of 6.0 mm and a length of 600 mm. In a recess 12 formed with the top end surface of the plug 8 as the bottom surface, 3.2 kg of magnesia clinker having a particle size of from 7.0 to 9.0 mm were placed, and on the layer of magnesia clinker, 8.7 kg of chromite having a particle size of from 0.1 to 2.0 mm, and then 48.0 kg of cutting scrap were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 8 under a pressure of 5.0 kg/cm$^2$ and at a flow rate of 500 Nl/minute. The packing 11 in the recess 12 was instantaneously removed by the pressure of the argon gas thus blown. Argon gas was continuously blown under a pressure of from 5.0 to 5.8 kg/cm$^2$ and at a flow rate of from 500 to 530 Nl/minute for 30 minutes. After the completion of the above-mentioned vacuum decarburization refining, the vacuum chamber was released to open air, and argon gas was continuously blown in open air under a pressure of 2.0 kg/cm$^2$ and at a flow rate of 200 Nl/minute for 20 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9 and thus closed the bore 9. Then, the refining vessel was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 8 was observed, and the small-diameter bore 9 having a length of 600 mm was completely closed by solidified steel over a depth of 500 mm from the top end thereof.

EXAMPLE 6

A refining vessel 6 identical with that in Example 2 except for a capacity of receiving 100 tons of molten steel and a thickness of the bottom wall 6' of 700 mm was employed.

The plug 8 was made of a high-alumina refractory, and a small-diameter bore 9 was formed by embedding a metal tube 10 made of stainless steel. The small-diameter bore 9 had a diameter of 6.0 mm and a length of 600 mm. In a recess 12 formed with the top end surface of the plug 8 as the bottom surface, 3.4 kg of magnesia clinker having a particle size of from 7.0 to 9.0 mm were placed, and on the layer of magnesia clinker, 8.5 kg of chromite having a particle size of from 0.1 to 2.0 mm, and then 45.0 kg of cutting scrap were piled up in layers as the packing 11.

Then, 100 tons of molten steel subjected to rough decarburization through a refining in an electric arc furnace were received in the refining vessel 6, and then, in order to apply a degassing to the molten steel in the refining vessel 6, argon gas was blown into the molten steel in the refining vessel 6 under vacuum through the small-diameter bore 9 of the plug 8 under a pressure of 5.0 kg/cm$^2$ and at a flow rate of 500 Nl/minute. The packing 11 in the recess 12 was instantaneously removed by the pressure of the argon gas thus blown. Argon gas was continuously blown under a pressure of from 5.0 to 5.8 kg/cm$^2$ and at a flow rate of from 450 to 500 Nl/minute for 20 minutes. After the completion of the above-mentioned degassing refining, argon gas was continuously blown in open air under a pressure of 2.0 kg/cm$^2$ and at a flow rate of 200 Nl/minute for 8 minutes to effect chemical composition adjustment, deoxidation and other refining operations. After the completion of the above-mentioned refining, when argon gas blowing was discontinued, a portion of the molten steel in the refining vessel 6 penetrated into the small-diameter bore 9 of the plug 8, was cooled and solidified in the bore 9 and thus closed the bore 9. Then, the refining vessel was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plub 8 was observed, and the small-diameter bore 9 having a length of 600 mm was completely closed by solidified steel over a depth of 580 mm from the top end thereof.

EXAMPLE 7

A refining vessel 6 with a plug 13 having the shape as shown in FIG. 5 inserted into the bottom wall 6' thereof was employed. The refining vessel 6 had a capacity of receiving 50 tons of molten steel, and the bottom wall 6' had a thickness of 400 mm.

The plug 13 was made of a high-alumina refractory, and a small-diameter bore 9 was formed directly in the plug 13. The small-diameter bore 9 had a diameter of 3.0 mm and a length of 200 mm. A helical cooling pipe 14 embedded in the lower part of the plug 13 so as to surround the small-diameter bore 9 had an inside diameter of 5.0 mm. In a recess 12 formed with the top end surface of the plug 13 as the bottom surface, 3.2 kg of magnesia clinker having a particle size of from 3.5 to 5.0 mm were placed, and on the layer of magnesia clinker, 8.3 kg of chromite having a particle size of from 0.1 to 2.0 mm, and then 35 kg of cutting scrap were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 13 under a pressure of 7.0 kg/cm$^2$ and at a flow rate of 280 Nl/minute. The packing 11 in the recess 12 was instantaneously removed by the pressure of the argon gas thus blown. Argon gas was continuously blown under a pressure of from 3.6 to 4.8 kg/cm$^2$ and at a flow rate of from 150 to 200 Nl/minute for 30 minutes. After the completion of the above-mentioned vacuum decarburization refining, the vacuum chamber was released to open air, and argon gas was continuously blown in open air under a pressure of 2.0 kg/cm$^2$ and at a flow rate of 80 Nl/minute for 20 minutes to effect chemical composition adjustment, deoxidation and other refining operations. On the other hand, the lower part of the small-diameter bore 9 was forcedly cooled by circulating cooling water at a flow rate of about 3.0 Nl/minute in the cooling pipe 14 of the plug 13. After the completion of the above-mentioned refining, when argon gas blowing was discontinued, a portion of the molten steel in the refining vessel 6 penetrated into the small-diameter bore 9 of the plug 13, was cooled and solidified in the bore 9 and thus closed the bore 9. Then, the refining vessel 6 was moved to above a casting mold, and the molten steel was poured into the casting mold through a teeming nozzle provided in the bottom wall 6' of the refining vessel 6.

After the completion of pouring, the plug 13 was removed from the bottom wall 6' of the empty refining vessel 6 and subjected to an inspection. According to the results of the inspection, no damage to the plug 13 was observed, and the small-diameter bore 9 having a length of 200 mm was completely closed by solidified steel over a depth of 140 mm from the top end thererof.

EXAMPLE 8

A refining vessel 6 identical with that in Example 7 was used except that a plug 17 having the shape as shown in FIG. 6 was inserted.

The plug 17 was made of a high-alumina refractory, and a small-diameter bore 9 was formed by embedding a metal tube 10 made of stainless steel. The small-diameter bore 9 had a diameter of 3.0 mm and a length of 200 mm. The cooling air inner pipe 18 and the cooling air outer pipe 19, both provided concentrically with the small-diameter bore 9 at the lower part of the plug 17, had a diameter of 6.0 mm and 8.0 mm, respectively. In a recess 12 formed with the top end surface of the plug 17 as the bottom surface, 3.5 kg of magnesia clinker having a particle size of from 3.5 to 5.0 mm were placed, and on the layer of magnesia clinker, 7.0 kg of chromite having a particle size of from 0.1 to 2.0 mm, and then 40 kg of cutting scrap were piled up in layers as the packing 11.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 17 under a pressure of 7.0 kg/cm$^2$ and at a flow rate of 280 Nl/minute. The packing 11 in the recess 12 was instataneously removed by the pressure of the argon gas thus blown. Then, argon gas was continuously blown under a pressure of from 3.6 to 4.8 kg/cm$^2$ and at a flow rate of from 150 to 200 Nl/minute for 30 minutes. After the completion of the above-mentioned vacuum decarburization refining, the vacuum chamber was released to open air, and argon gas was continuously blown in open air under a pressure of 2.0 kg/cm$^2$ and at a flow rate of 80 Nl/minute for 20 minutes to effect chemical composition adjustment, deoxidation and other refining operations. On the other hand, the lower part of the small-diameter bore 9 was forcedly cooled by circulating cooling air at a flow rate of from 50 to 200 Nl/minute in the cooling air inner pipe 18 and the cooling air outer pipe 19. After the completion of the above-mentioned refining, when argon gas blowing was discontinued, a portion of the molten steel in the refining vessel 6 penetrated into the small-diameter bore 9 of the plug 17, was cooled and solidified in the bore 9 and thus closed the bore 9. Then, the refining vessel 6 was moved to above a casting mold, and the molten steel was poured into the casting mold through a teeming nozzle provided in the bottom wall 6' of the refining vessel 6.

After the completion of pouring, the plug 8 was removed from the bottom wall 6' of the empty refining vessel 6 and subjected to an inspection. According to the results of the inspection, no damage to the plug 17 was observed, and the small-diameter bore 9 having a length of 200 mm was completely closed by solidified steel over a depth of 145 mm from the top end thereof.

EXAMPLE 9

A refining vessel 6 with two plugs 8A and 8B having the shape as shown in FIG. 7 inserted into the bottom wall 6' thereof was employed. The refining vessel 6 has a capacity capable of receiving 50 tons of molten steel, and the bottom wall 6' had a thickness of 430 mm.

The plugs 8A and 8B were made of a high-alumina refractory, and a small-diameter bore 9 was formed directly in each of the plugs 8A and 8B. The small-diameter bore 9 had a diameter of 2.5 mm and a length of 300 mm. In recesses 12A and 12B formed with the top end surfaces of the plugs 8A and 8B as the bottom surfaces, 3.5 kg of magnesia clinker having a particles size of from 3.0 to 4.0 mm were placed, and on the layer of magnesia clinker, 50 kg of silica sand was piled up in a layer as the packings 11A and 11B, respectively.

Then, 50 tons of molten steel subjected to rough decarburization through a refining in an electric arc furnace were received in the refining vessel 6, and then, the refining vessel 6 was housed in a vacuum chamber in order to apply a vacuum decarburization to the molten steel in the refining vessel 6. Under vacuum, argon gas was blown into the molten steel in the refining vessel 6 through the small-diameter bore 9 of the plug 8A under a pressure of 7.1 kg/cm$^2$ and at a flow rate of 200 Nl/minute. The packing 11A in the recess 12A was instantaneously removed by the pressure of the argon gas thus blown. Argon gas was continuously blown through the small-diameter bore 9 of the plug 8A under a pressure of from 6.8 to 7.1 kg/cm$^2$ and at a flow rate of from 190 to 210 Nl/minute for 30 minutes. After the completion of the above-mentioned vacuum decarburization refining, when argon gas blowing was discontinued, a portion of the molten steel in the refining vessel 6 penetrated into the small-diameter bore 9 of the plug 8A, was cooled and solidified in the bore 9 and thus closed the bore 9. Then, the refining vessel was moved to outside the vacuum chamber in order to subject the molten steel in the refining vessel 6 to chemical composition adjustment in open air. In open air, argon gas was blown into the molten steel in the refining vessel 6 through the small-diameter bore 9 of the plug 8B under a pressure of 7.3 kg/cm$^2$ and at a flow rate of 220 Nl/minute. The packing 11B in the recess 12B was instantaneously removed by the pressure of the argon gas thus blown. Argon gas was continuously blown through the small-diameter bore 9 of the plug 8B under a pressure of from 6.9 to 7.3 kg/cm$^2$ and at a flow rate of from 190 to 220 Nl/minute for 20 minutes. After the completion of the above-mentioned chemical composition adjustment, when argon gas blowing was discontinued, a portion of the molten steel in the refining vessel 6 penetrated into the small-diameter bore 9 of the plug 8B, was cooled and solidified in the bore 9 and thus closed the bore 9. Then, the refining vessel was moved to above a casting mold, and the molten steel was poured into the casting mold through a teeming nozzle provided in the bottom wall 6' of the refining vessel 6.

After the completion of pouring, the plugs 8A and 8B were removed from the bottom wall 6' of the empty refining vessel 6 and subjected to an inspection. According to the results of the inspection, no damage to the plugs 8A and 8B was observed, and the respective small-diameter bores 9 having a length of 300 mm were completely closed by solidified steel over a depth of 150 mm from the respective top end thereof.

REFERENCE 1

A refining vessel 6 with a plug 8 having the shape as shown in FIG. 4 inserted into the bottom wall 6' thereof was employed. The refining vessel 6 has a capacity capable of receiving 50 tons of molten steel, and the bottom wall 6' had a thickness of 650 mm.

The plug 8 was made of a high-alumina refractory, and a small-diameter bore 9 was formed by embedding a metal tube 10 made of stainless steel. The small-diameter bore 9 had a diameter of 7.0 mm and a length of 600 mm. In a recess 12 formed with the top end surface of the plug 8 as the bottom surface, 3.2 kg of magnesia clinker having a particle size of from 7.5 to 9.0 mm were placed, and on the layer of magnesia clinker, 8.7 kg of chromite having a particle size of from 0.1 to 2.0 mm, and then, 48.0 kg of cutting scrap were piled up in layers as the packing 11.

Then, 50 tons of molten steel subjected to rough decarburization through a refining in an electric arc furnace were received in the refining vessel 6, and then, the molten steel in the refining vessel 6 was subjected to vacuum decarburization refining and chemical composition adjusting refining by blowing argon gas through the small-diameter bore 9 of the plug 8 under the same conditions as in Example 5. After the completion of the above-mentioned refining treatments, when argon gas blowing was discontinued, a portion of the molten steel in the refining vessel 6 penetrated into the small-diameter bore 9 of the plug 8, was cooled and solidified in the bore 9, and thus closed the bore 9. However the lower end of the solidified steel projected by 100 mm from the lowermost end of the bore 9. This suggests the risk of the molten steel in the refining vessel 6 flowing out from the bore 9 when discontinuing gas blowing.

After the completion of pouring, the plug 8 was removed from the bottom wall 6' of the empty refining vessel 6 and subjected to an inspection. According to the results of the inspection, the steel having penetrated into the small-diameter bore 9 and having been solidified therein had a length of 700 mm from the top end of the bore 9, thus projecting by 100 mm from the lowermost end of the bore 9.

According to the method of the present invention, as described above in detail, it is possible to blow a larger quantity of gas from below into the molten steel in the refining vessel as compared with the conventional method for blowing a gas, which comprises inserting a porous plug into a gas blowing aperture provided in the bottom wall of a refining vessel, and blowing a gas from below into a molten steel in the refining vessel through the porous plug. When discontinuing gas blowing, the small-diameter bore of the plug is completely closed by the solidification of the molten steel pentrating into said bore, thus ensuring prevention of the molten steel in the refining vessel from flowing out. Furthermore, since the plug used in the present invention does not require such careful handling as in the conventional porous plug which is very fragile, the plug of the present invention can be replaced in only about 10 minutes with simple operations, thus improving the operating efficiency of the refining vessel. The plug used in the present invention, which is less expensive than the coventional porous plug, can be economically used even when replacing the plug for each gas blowing. Since, when discontinuing gas blowing, solidification of the molten steel having penetrated into the small-diameter bore of the plug ensures prevention of the molten steel in the refining vessel from flowing out, as mentioned above, it is not necessary to install a tilting mechanism of said vessel as in the conventional refining vessel provided with a gas blowing hole in the bottom wall thereof, for the purpose of preventing the molten steel in the refining vessel from flowing out. Thus, according to the method for blowing a gas of the present invention, many industrially useful effects are provided.

What is claimed is:

1. A method for blowing gas from below into molten steel received in a refining vessel, which comprises:

using a refining vessel including at least one gas blowing aperture provided in the bottom wall thereof and a frustoconical plug matching with said gas blowing aperture, releasably inserted into said gas blowing aperture from the outside of said bottom wall, which has a small-diameter bore having a diameter within the range of from 0.5 to 6.0 mm and a length within the range of from 60 to 700 mm;

closing the top end of said small-diameter bore of said plug opening into said vessel with a granular packing which is removable by the pressure of the gas blown, thereby ensuring prevention, during receiving a molten steel into said vessel, of said received molten steel from penetrating into said small-diameter bore;

blowing from below a gas having a pressure of over the static pressure of said molten steel through said small-diameter bore of said plug, after receiving said molten steel in said vessel, into said received molten steel, thereby instantaneously removing said granular packing to effect a prescribed gas blowing into said molten steel; and after discontinuing said gas blowing, causing a portion of said molten steel in said vessel to penetrate by gravity into said small-diameter bore of said plug to solidify the molten steel in said small-diameter bore, thereby closing said small-diameter bore to ensure prevention of said molten steel in said vessel from flowing out from said vessel.

2. The method as claimed in claim 1, wherein said small-diameter bore comprises a small-diameter metal tube.

3. The method as claimed in claim 1, wherein:

the periphery of said small-diameter bore is forcedly cooled by circulating cooling water in a helical cooling pipe provided around the periphery of said small-diameter bore in said plug.

4. The method as claimed in claim 2, wherein:

the periphery of said small-diameter bore is forcedly cooled by circulating cooling air in a cooling air inner pipe and a cooling air outer pipe provided concentrically with said small-diameter metal tube as the center in said plug.

5. The method as claimed in any of claims 1 to 4, wherein:

a refining vessel is used, which includes at least two gas blowing apertures provided in the bottom wall thereof, and respective plugs each having said small-diameter bore, which are inserted respectively in said at least two gas blowing apertures; and, multiple-stage gas blowing including at least one interruption is effected by sequentially using said plugs.

* * * * *